United States Patent [19]

Cahen, Jr.

[11] 4,292,757

[45] Oct. 6, 1981

[54] COLLAPSIBLE WING AIRCRAFT

[76] Inventor: George L. Cahen, Jr., 130 Appletree Rd., Charlottesville, Va. 22903

[21] Appl. No.: 33,805

[22] Filed: Apr. 26, 1979

Related U.S. Application Data

[63] Continuation-in-part of Ser. No. 813,976, Jul. 8, 1977, abandoned.

[51] Int. Cl.[3] ..... A63H 27/00

[52] U.S. Cl. ..... 46/80; 46/81

[58] Field of Search ..... 46/80, 81, 79, 76 R, 46/74 R, 1 L; 244/153 R, 154

[56] References Cited

U.S. PATENT DOCUMENTS

| | | | |
|---|---|---|---|
| 1,054,374 | 2/1913 | Voigt | 46/79 |
| 1,190,343 | 7/1916 | Tyrrell | 46/80 |
| 1,353,147 | 9/1920 | Converse | 46/80 |
| 1,599,280 | 9/1926 | Lewis | 46/80 |
| 2,221,012 | 11/1940 | Walker | 46/80 |
| 2,529,979 | 11/1950 | Turnbull | 46/79 |
| 3,204,368 | 9/1965 | Effinger, Jr. et al. | 47/78 |
| 3,433,210 | 3/1969 | Schnitz | 46/80 X |
| 3,526,989 | 9/1970 | Wallace | 46/79 |
| 3,706,430 | 12/1972 | Kline et al. | 244/35 |
| 3,752,423 | 8/1973 | Schaeffer | 244/153 R |

FOREIGN PATENT DOCUMENTS

| | | | |
|---|---|---|---|
| 165755 | 9/1949 | Austria | 46/80 |
| 903073 | 7/1949 | Fed. Rep. of Germany | 46/80 |
| 499097 | 11/1954 | Italy | 46/80 |

*Primary Examiner*—G. E. McNeill
*Assistant Examiner*—Mickey Yu
*Attorney, Agent, or Firm*—LeBlanc, Nolan, Shur & Nies

[57] ABSTRACT

An aircraft of the heavier than air type which has wings that can be deployed from a collapsed launch configuration to an extended flight position by an on-board power source.

20 Claims, 9 Drawing Figures

10
14
16
20
22
24
26
28
35
36
38
40
42
46
54
56
58
60
62
64
66
68
70
72
74
80
81
82
83
84
90
91
92
93
94
95
96
97
98

10
12
16
20
26
28
34
35
42
46
54
70
92

COLLAPSIBLE WING AIRCRAFT

This application is a continuation-in-part of application Ser. No. 813,976 filed July 8, 1977 now abandoned.

The present invention relates to heavier than air type aircraft and, more particularly, to aircraft of that type which have collapsible wings and an on-board power source for biasing the wings from their collapsed configuration into an extended, flight configuration.

One application in which the principles of the present invention have been applied with singular success is in the provision of toy gliders, and the principles of the invention will accordingly be explained and developed primarily with reference to that application. It is to be understood, however, that this is being done for brevity and clarity and is not intended to limit the scope of the invention as defined in the claims appended hereto.

Aircraft with deployable wings are well-known with the most familiar of these probably being versions of the swing wing design. The prior art relating to deployable wing aircraft and pertinent to the patentability of my invention of which I am aware consists of U.S. Pat. Nos. 1,054,374 issued Feb. 25, 1913, to Voigt; 1,190,343 issued July 11, 1916, to Tyrell; 1,353,147 issued Sept. 21, 1920, to Converse; 1,599,280 issued Sept. 7, 1926, to Lewis; 2,221,012 issued Nov. 12, 1940, to Walker; 3,204,368 issued Sept. 7, 1965, to Effinger, Jr.; 3,408,767 issued Nov. 5, 1968, to Anderson; and 3,433,210 issued Mar. 18, 1969, to Schnitz; Austrian Pat. No. 165,755; German Pat. No. 903,073; and Italian Pat. No. 499,097.

It is one important and primary object of the invention to provide novel, improved aircraft of the deployable wing type.

Another, also important and primary object of my invention resides in the provision of deployable wing aircraft with advantages and features that are not possessed by heretofore proposed aircraft of that type.

Still other important, but more specific, objects of my invention include the provision of aircraft in accord with the preceding object which can be economically constructed and which have superior launch and flight characteristics.

Those and other important objects of my invention are attained by a novel construction in which the aircraft wings have sections that are hinged to each other along fore-and-aft hinge lines. The wings can be collapsed to a launch configuration* by displacing adjacent wing sections about the hinge line shared by them; and the wings are deployed from that configuration to an extended flight configuration by an on-board power source to spread the wings, typically into a modified delta wing form.

*The term "launch" is employed herein in a somewhat broader than conventional sense as the wings of aircraft employing the principles of my invention may be collapsed for purposes of storage, transportation, etc. Irrespective of the purpose for which the wings are collapsed, the resulting configuration of the aircraft will be referred to as the launch configuration.

Certain important objects and advantages of my invention have been described above. Other important objects and features and additional advantages of the invention will become apparent from the appended claims and as the ensuing detailed description and discussion proceeds in conjunction with the accompanying drawing, in which:

Figure 1:
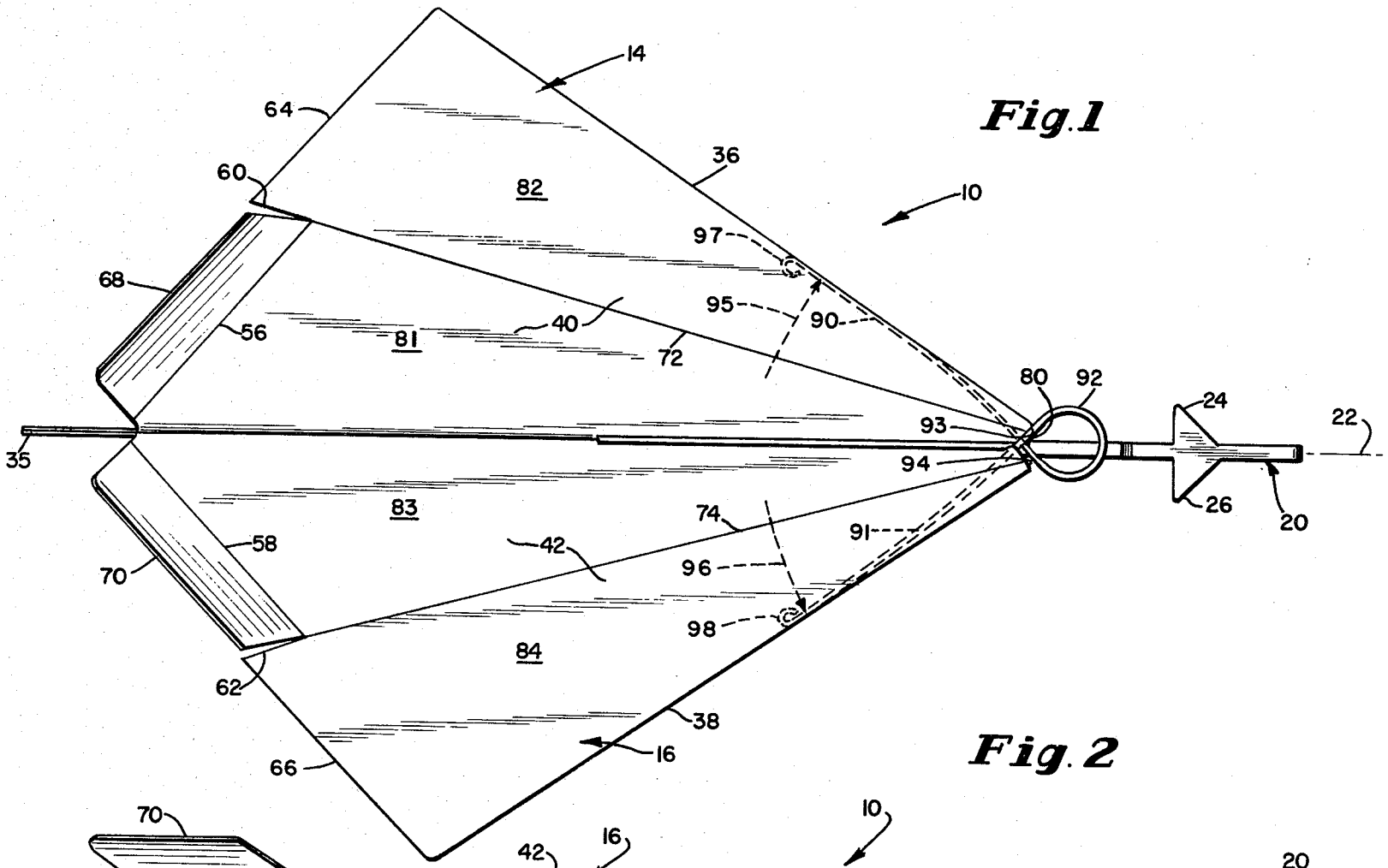
FIG. 1 is a top view of a toy glider embodying and constructed in accord with the principles of the present invention, the wings of the glider being in an extended, flight configuration.

Referring now to the drawing, FIGS. 1–7 depict a toy glider 10 constructed in accord with, and embodying, the principles of the present invention.

The description of glider 10 which follows, and the appended claims, employ a number of direction-related terms such as upper, lower, vertical, etc. Unless otherwise specified, these are related to the glider as oriented in its flight attitude.

Figure 2:
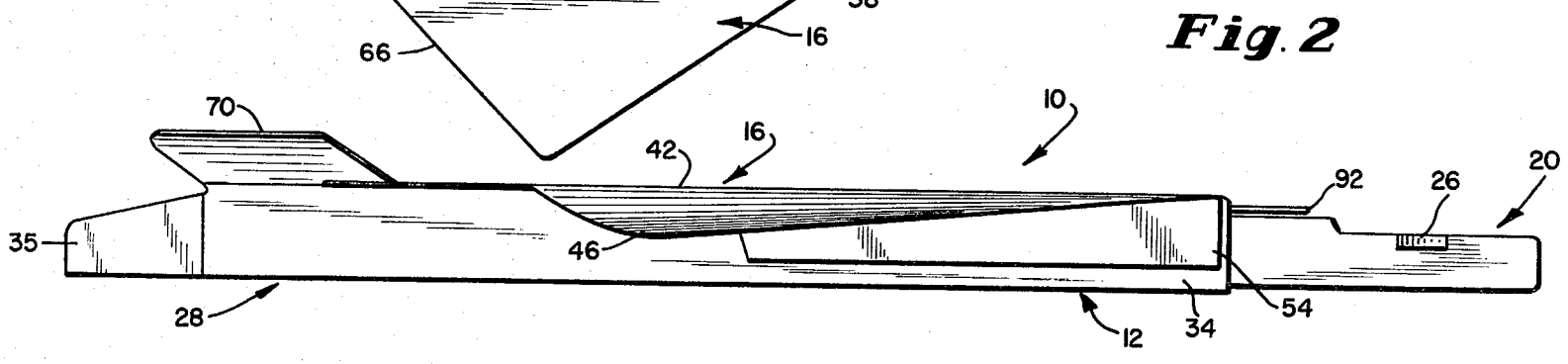
FIG. 2 is a side view of the glider.
Figures 3, 4, 5, 6, 7:
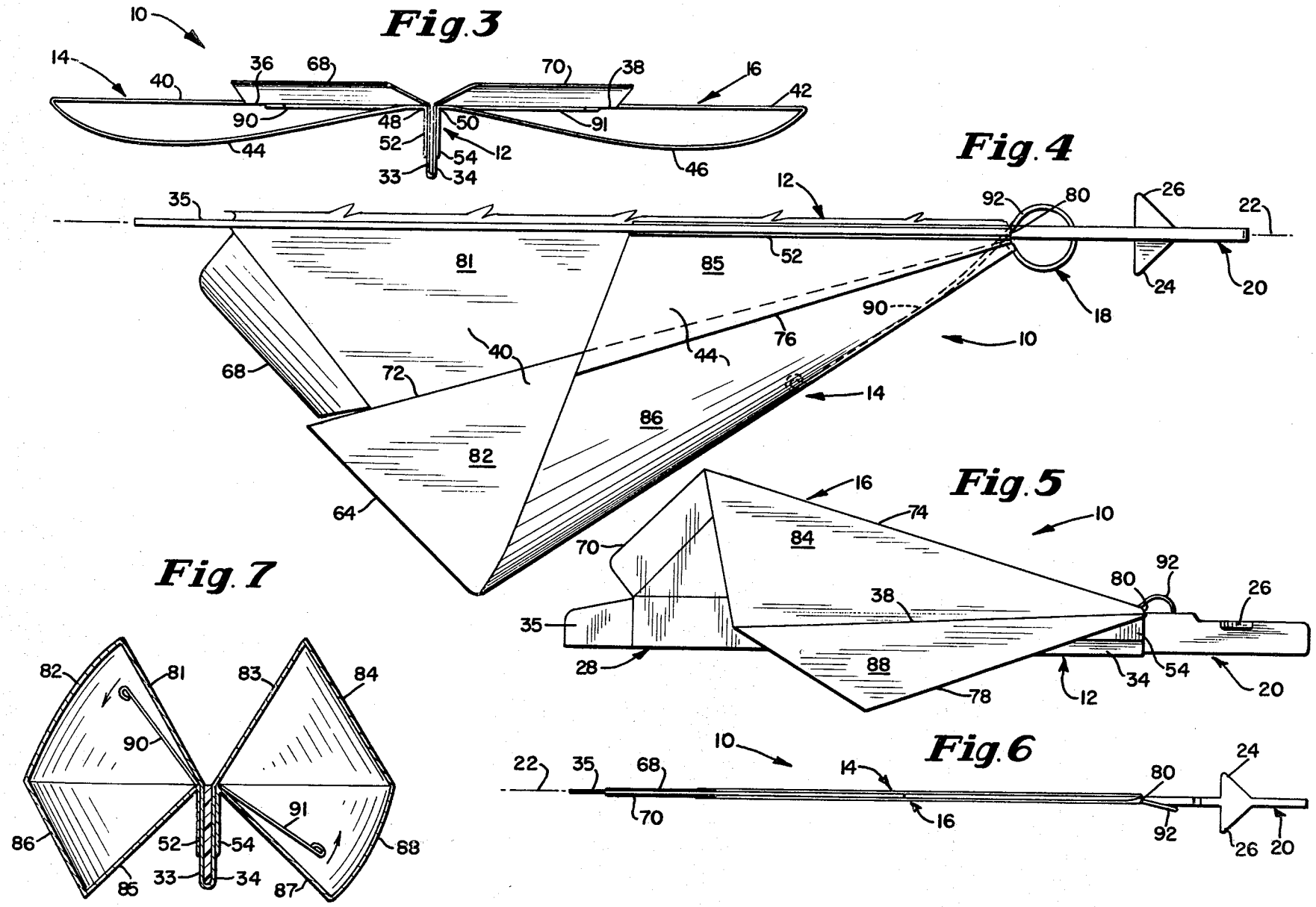
FIG. 3 is a rear view of the glider.
FIG. 4 is a partial bottom view of the glider.
FIG. 5 is a side view of the glider with the wings in a collapsed, launch configuration.
FIG. 6 is a top view of the glider with the wings in the launch configuration.
FIG. 7 is a rear view of the glider with the wings partially deployed to show the relationship between the wings and a power source by which they are deployed from the launch configuration to the flight configuration.

The major components of glider 10 are a fuselage 12, wings 14 and 16 of a modified delta configuration, and an on-board power source 18 for deploying wings 14 and 16 from the collapsed, launch configuration shown in FIGS. 5 and 6 to the extended, flight configuration shown in FIGS. 1–4.

Fuselage 12 of the airplane has an elongated, front member or keel 20 arranged with its axis of elongation coincidental with a fore-and-aft axis 22 of the glider. Keel 20 has a generally rectangular configuration with its major cross-sectional dimension extending vertically. Transversely extending launching lugs 24 and 26 are formed at the forward end of the keel which will typically be fabricated by molding from a styrene or other suitable plastic.

Figure 9:
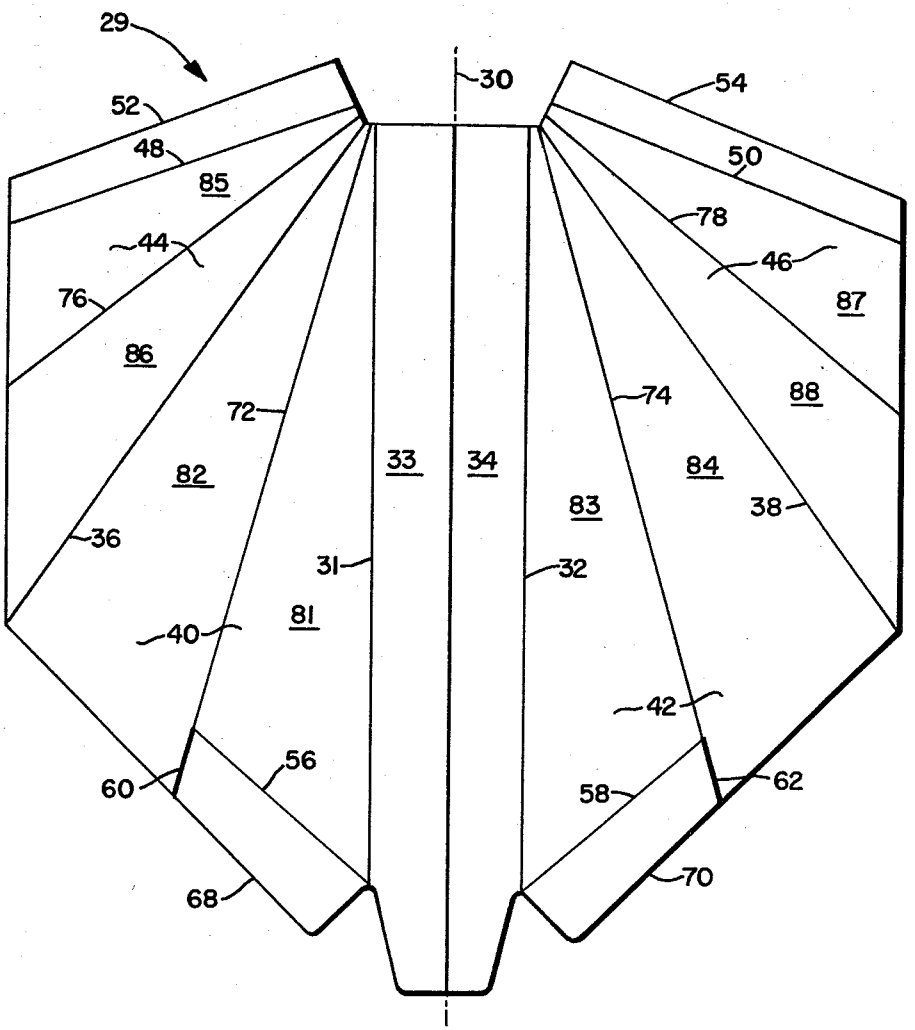
FIG. 9 is a plan view of a blank which can be folded to form the rear fuselage, wings, rudder, and elevons (or elevators) of the glider.

The rear or aft section 28 of fuselage 12 and wings 14 and 16 are formed by folding a blank 29 cut from a durable, flexible, sheet material (see FIG. 9). Various cardboards, papers, plastics, plastic laminated papers, and other materials can be employed. The preferred material, at present, is TYVEK, a spunbonded olefin produced by E. I. Dupont de Nemours and Co. and described in more detail in Dupont Bulletin TK-3 dated December 1978 and now incorporated herein by reference.

The rear section 28 of fuselage 12 is formed by folding blank 29 along an axis of symmetry 30 corresponding to the fore-and-aft centerline 22 of glider 10 and again along lines 31 and 32, leaving elongated, depending flaps 33 and 34, best shown in FIG. 3. The forward ends of those flaps are permanently fixed to opposite sides of keel 20, preferably by an appropriate adhesive such as UPACO Adhesive, Inc. 9229-A Hot Melt Adhesive.

Typically, the keel will be located in a protruding position as shown in FIGS. 1 and 2 to optimally locate the center of gravity of the glider.

Those portions of the flaps extending rearwardly from the aft end of keel 20 constitute the rear section 28 of fuselage 12 and, also, provide a rudder 35.

Blank 29 is also creased to form hinge lines 36 and 38 which, as best shown in FIG. 1, are coincidental with the leading edges of wings 14 and 16. The blank is then folded back on itself along hinge lines 36 and 38, giving the wings upper skins 40 and 42 (see FIG. 1) and lower skins 44 and 46 (see FIGS. 3 and 4). Upper skins 40 and 42 are joined to lower skins 44 and 46 at the outboard edges of those skins along hinge lines 36 and 38, respectively.

In the illustrated glider 10, the upper skins 40 and 42 combine to form a diamond configuration; and the lower skins, which are substantially shorter than the upper skins, have mirror image-related, triangular configurations. Those skilled in the relevant arts will readily recognize that the wing design just described differs from a delta wing primarily only in the presence of those triangular portions of the upper wing skins aft of the leading edges of wings 14 and 16.

Blank 29 is also folded at the inboard edges of lower wing skins 44 and 46 along fore-and-aft extending lines 48 and 50 (see FIG. 3), forming depending flaps 52 and 54. These overlie the sides 33 and 34 of rear fuselage 28 and are permanently affixed to the latter as by the UPACO adhesive identified above.

Referring again to FIG. 1, the upper skins 40 and 42 of wings 14 and 16 are creased or scored along lines 56 and 58 at the rear of the glider, and slits 60 and 62 are formed from the outboard ends of the score lines to the trailing edges 64 and 66 of the wings. This leaves tabs 68 and 70 which function as elevons or elevators.

Turning now to both FIGS. 1 and 4, hinge lines 72 and 74 extending in generally the same direction as the fore-and-aft axis 22 of glider 10 are formed in the upper skins 40 and 42 of wings 14 and 16 intermediate the inboard and outboard edges of those wings as by creasing, scoring, etc.; and similar hinge lines 76 and 78 are formed in the lower skins 44 and 46 of the wings. Hinge lines 72, 74, 76, and 78 and the hinge lines 36 and 38 described earlier all converge toward a common location 80 at the forwardmost end or tip of the wing structure.

Hinge line 72 divides the upper skin 40 of wing 14 into inboard and outboard sections 81 and 82 which can be displaced or folded relative to each other along the hinge line. The upper skin 42 of wing 16 and the lower skins 44 and 46 of wings 14 and 16 are divided into similarly related inboard and outboard sections 83 and 84, 85 and 86, and 87 and 88 along hinge lines 74, 76, and 78.

The wing construction just described is provided so that wings 14 and 16 can be collapsed into the relatively streamlined launch configuration shown in FIGS. 5 and 6 and deployed from that configuration to the extended, flight position shown in FIGS. 1–4. It is the function of the on-board power source 18 to effect that deployment coincidentally with the removal from the glider of forces maintaining wings 14 and 16 in the launch configuration.

In the illustrated, exemplary glider 10 this energy producing device is one of the snap action type as will become apparent hereinafter and, otherwise characterized, is an elastic type of energy storage device. The particular device of that character employed in glider 10 is a hairpin type spring having legs 90 and 91 and a single turn spring coil 92.

Spring 18 is housed in the wings 14 and 16 of the glider with leg 90 in wing 14 and leg 91 in wing 16. The spring is installed by squeezing those legs together and inserting them into the wings through apertures 93 and 94 in wings 14 and 16, respectively, at the tip 80 of the wing structure.

In the extended, flight configuration shown in FIG. 1, the legs 90 and 91 of spring 18 engage wings 14 and 16 along hinge lines 36 and 38. They exert outwardly directed forces, indicated by arrows 95 and 96, which maintain the wings in the flight configuration.

Wings 14 and 16 are collapsed by exerting opposite directed forces inwardly toward the fore-and-aft axis 22 of glider 10 on them at the level of hinge lines 36 and 38. This causes the upper and lower, inboard and outboard sections 81 and 82 and 85 and 86 of wing 14 to fold toward each other along hinge lines 72 and 76, and the two outboard sections 82 and 86 to concomitantly fold or hinge away from each other along hinge line 36. This results in wing 14 passing through the configuration shown in FIG. 7 and then assuming the configuration shown in FIGS. 5 and 6 in which the wing lies flat against fuselage 12 with its major transverse dimension at right angles to what it was with that wing in the extended, flight configuration of FIG. 1 (see FIGS. 5 and 6).

By similar relative displacements of its upper and lower inboard and outboard sections and its two outboard sections, wing 16 is displaced to a collapsed configuration bearing a mirror image relationship to that of wing 14 as best shown in FIG. 6.

Application of the forces just discussed to displace wings 14 and 16 to the illustrated, launch configuration concurrently cause the leg 90 of spring 18 to shift upwardly from hinge line 36 to the hinge line 72 between the inboard and outboard sections 81 and 82 of upper skin 40 of wing 14. These forces concurrently shift leg 91 of the spring downwardly from its location at hinge line 38 of wing 16 to the hinge line 78 between the inboard and outboard sections 87 and 88 of that wing's bottom skin 46*. These movements are facilitated by the relatively low coefficient of friction of the preferred wing material and by loops 97 and 98 at the free ends of the spring legs.

*This action may be reversed with leg 90 sliding along lower outboard skin section 86 of wing 14 to hinge line 76 and leg 91 shifting along upper outboard skin section 84 of wing 16 to hinge line 74.

The displacement of the spring legs just described rotates the spring as an entity through an angle of approximately 90° about an axis lying in the same vertical plane as the fore-and-aft axis of symmetry 22 of glider 10. As this occurs, the distance between the free ends of the spring legs is decreased (from 2 and 15/16 to 1 and 9/16 inches in one exemplary toy glider of the type illustrated in the drawing). This loads or stresses, storing potential energy in, the spring.

Upon removal of launch configuration maintaining forces acting in the directions just described, spring 18 restores to the relaxed configuration shown in FIG. 1, the spring rotating in its entirety and about its axis of symmetry through the same 90° angle discussed above, but in the opposite direction. Because of the rotary motion of the spring, the above-discussed physical relationship between the spring and wings 14 and 16, and the elasticity of the material from which the wings are fabricated, the spring will first exert on the wings a force which increases in magnitude from a relatively low level in proportion to the angular displacement of the spring. As this force reaches a maximum, the spring snaps through the remainder of its travel to the relaxed condition.

As the spring restores to its relaxed condition, the spring legs shift from the hinge lines at which they are disposed with the wings in the collapsed configuration to hinge lines 36 and 38. Those movements of the spring legs result in their spreading or deploying wings 14 snd 16 to the extended, flight configuration of FIGS. 1 and 3 by reversing the above-discussed, folding or hinged movements of the inboard and outboard skin sections relative to each other along the hinge lines.

Figure 8:
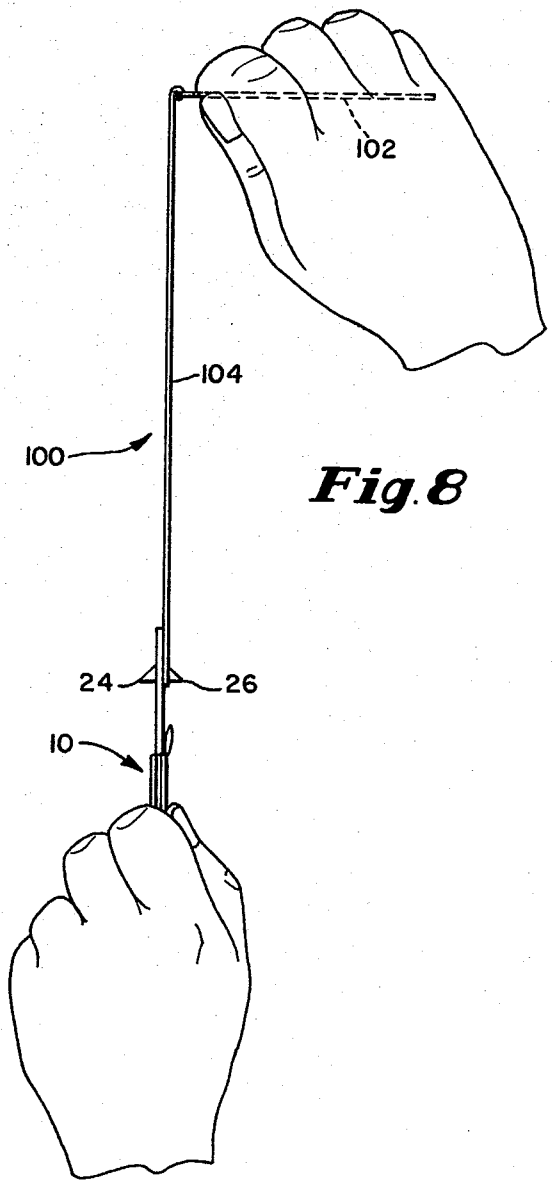
FIG. 8 is a pictorial view of one procedure and mechanism which can be used to launch the glider.

One exemplary technique for launching glider 10 and the device employed for that purpose are shown in FIG. 8.

The launcher, identified by reference character 100, includes a handle 102 to which an elastic band 104 is fixed.

To launch glider 10, wings 14 and 16 are collapsed as described above and held in that configuration. The free end of elastic band 104 is hooked over one of the launching lugs 24 or 26 at the forward end of the glider, the band stretched, and the glider released vertically, allowing the elastic to contract and propel the glider into a vertical climb.

Initially, the rate-of-climb is relatively high. Under these conditions, air resistance (or friction between the air and the glider) generates forces with vectors which maintain wings 14 and 16 in the collapsed, streamlined, launch configuration. This is desirable as it enables the glider to climb higher for a launching force of given magnitude than it would be able to do if the wings were in the extended, flight configuration or even in a partially deployed configuration such as that shown in FIG. 7.

The desirable attribute of the wings remaining in the collapsed configuration during launch is promoted by my novel aircraft design because, as discussed above, the spring force available to deploy the wings to the flight configuration is relatively low when the wings are fully collapsed.

As the glider reaches the zenith of the launch, the vector forces generated by air resistance decrease to a level below those which spring 18 is capable of generating. At this point, therefore, the spring rotatably restores from the FIG. 5 position to the FIG. 1 position. As discussed above, that deploys wings 14 and 16 to the flight configuration, which makes them capable of generating the greatest lift and thereby maximizing the flight time of the glider.

I pointed out above that the illustrated launcher is merely exemplary. Aircraft involving the principles of the present invention can equally well be launched by other techniques including those employing compressed gases and spring and other mechanical devices. And they can also be carried aloft by a rocket or other vehicle, for example.

As indicated previously, glider 10 is only one preferred embodiment of my invention. Consequently, the foregoing detailed description and discussion of that embodiment is not intended to limit the scope of coverage to which I consider myself entitled, especially as the principles of my invention may be embodied in devices and machines which differ radically from glider 10 in size, configuration, materials of construction, wing deploying power source, etc. The scope of the invention is instead intended to be limited only by the appended claims; and all changes which come within the meaning and range of equivalency of these claims are intended to be embraced therein.

What is claimed and desired to be secured by Letters Patent is:

1. An aircraft of the heavier than air type which comprises wings deployable between a launch configuration in which said wings are collapsed and a flight configuration in which said wings are extended and a power source for deploying said wings from the launch configuration to the flight configuration, said power source comprising a hairpin spring which is rotatably restorable in its entirety about an axis of the aircraft, as an adjunct to the removal of a restraint maintaining said wings in the collapsed configuration, from a first orientation in which energy is stored therein in potential form to a second orientation in which said means is in a condition which has, in the course of being arrived at, permitted the energy stored therein in potential form to be converted to kinetic form and thereby deploy said wings, said power source being housed in the wings of said aircraft.

2. An aircraft as defined in claim 1 wherein there are apertures in the leading edges of said wings through which the legs of said spring can be introduced into said wings in the course of housing said spring in said wings.

3. An aircraft of the heavier than air type which comprises wings deployable between a launch configuration in which said wings are collapsed and a flight configuration in which said wings are extended and a power source for deploying said wings from the launch configuration to the flight configuration, said power source comprising an elastic energy storage means which is housed in said wings, which is rotatable in its entirety about an axis extending in the same direction as the fore-and-aft axis of said aircraft, and which is in a condition when said wings are in said flight configuration that has in the course of being arrived at permitted energy stored therein in potential form to be converted to kinetic form and thereby deploy said wings and said wings having relatively displaceable inboard and outboard portions which are so engageable with said energy storage means appurtenant to the shifting of said wings from said flight configuration to said launch configuration as to rotate said means about said axis thereof and consequentially store in said means the potential energy for effecting the subsequent deployment of said wings from their launch configuration to their flight configuration.

4. An aircraft of the heavier than air type which comprises wings deployable between a launch configuration in which said wings are collapsed and a flight configuration in which said wings are extended and an onboard, snap action type power source which both rotates in its entirety and expands as an adjunct to the removal of a restraint maintaining said wings in the collapsed configuration to deploy said wings from the launch configuration to the flight configuration, said power source being housed in the wings of said aircraft.

5. An aircraft as defined in claim 4 wherein said power source is a hairpin spring.

6. An aircraft as defined in claim 5 wherein there are apertures in the leading edges of said wings through which the legs of said spring can be introduced into said wings in the course of housing said spring in said wings.

7. An aircraft of the heavier than air type comprising wings which have bipartite upper and lower skins with inboard and outboard sections, the inboard and outboard sections of each said skin being hingedly connected together and the outboard sections of said wings being similarly connected, all along fore-and-aft oriented hinge lines, said wings being deployable between a launch configuration in which said wings are collapsed and a flight configuration in which said wings are extended by relative movement between adjoining skin sections about said hinge lines and said aircraft further comprising an onboard power source which is rotatable about an axis extending in the same direction as the fore-and-aft axis of the aircraft for deploying said wings from said launch condition to said flight condition by effecting relative movement between said skin sections as aforesaid.

8. An aircraft as defined in either claim 7 or claim 1 wherein there is an orthogonal relationship between the major transverse dimensions possessed by said wings in the collapsed and the extended configurations thereof.

9. An aircraft of the heavier than air type which comprises wings and means for deploying said wings from a launch configuration in which said wings are collapsed to a flight configuration in which said wings are extended; said wings each having portions hinged along first and second lines extending in the same direction as the fore-and-aft axis of the aircraft and the means for deploying said wings comprising an operator which is engageable with one of said wings along the second hinge line thereof when said wings are in the launch configuration and means for biasing said operator from the aforesaid hinge line of the wing with which it is associated to the first hinge line of that wing to spread said wing from the launch configuration to the flight configuration thereof.

10. An aircraft as defined in claim 9 wherein each of said wings has a third hinge line oriented as aforesaid and on the opposite side of the first hinge line from the second hinge line, wherein the means for deploying said wings comprises a second operator which is engageable with the other of said wings along the third hinge line thereof when said wings are in the launch configuration, and wherein said biasing means is operable to, concomitantly with the spreading of said one wing, bias said second operator from the third hinge line of the wing with which it is associated to the first hinge line of that wing to spread that wing from the launch configuration to the flight configuration thereof.

11. An aircraft as defined in claim 10 wherein said means for deploying said wings comprises a spring housed therein for rotation in its entirety about an axis extending in the same direction as the fore-and-aft axis of the aircraft, the aforesaid operators being legs of said spring.

12. An aircraft as defined in claim 10 in which the first, second, and third hinge lines of each said wing extend to a common location at a forward tip of said wing.

13. An aircraft as defined in claim 10 wherein each wing has an upper skin and a lower skin, wherein said second and third hinge lines are respectively located in the lower and upper skins of the wing, and wherein said upper and lower skins are integrated at the outboard edge of the wing along said first hinge line.

14. An aircraft as defined in either of the preceding claims 3 or 9 wherein said wings are fabricated of a bonded polyolefin sheet material.

15. An aircraft as defined in either of the preceding claims 3 or 9 wherein said wings are of a delta design.

16. An aircraft as defined in claim 3 wherein said power source is a hairpin spring.

17. An aircraft of the heavier than air type which comprises wings deployable between a launch configuration in which said wings are collapsed and a flight configuration in which said wings are extended and a power source for deploying said wings from the launch configuration to the flight configuration, said power source comprising an elastic energy storage means which is rotatably restorable in its entirety about one axis of the aircraft, and has components movable away from each other in curved paths as an adjunct to the removal of a restraint maintaining said wings in the launch configuration, from a first orientation in which energy is stored therein in potential form to a second orientation in which said means is in a condition which has, in the course of being arrived at, permitted the energy stored therein in potential form to be converted to kinetic form and thereby deploy said wings, said components of said power source being housed in the wings of said aircraft.

18. An aircraft of the heavier than air type comprising wings which have bipartite upper and lower skins with inboard and outboard sections, the inboard and outboard sections of each said skin being hingedly connected together and the outboard sections of said wings being similarly connected, all along fore-and-aft oriented hinge lines, said wings being deployable between a launch configuration in which said wings are collapsed and a flight configuration in which said wings are extended by relative movement between adjoining skin sections about said hinge lines and said aircraft further comprising an onboard hairpin spring power source which is rotatable in its entirety about an axis extending in the same direction as the fore-and-aft axis of said aircraft for deploying said wings from said launch condition to said flight condition by effecting relative movement between said skin sections as aforesaid.

19. An aircraft as defined in any of the preceding claims 17, 4, 7 or 18 wherein said wings are fabricated of a bonded polyolefin sheet material.

20. An aircraft as defined in any of the preceding claims 17, 4, 7, or 18 wherein said wings are of a delta design.

* * * * *